US007552510B2

(12) United States Patent
Harold et al.

(10) Patent No.: US 7,552,510 B2
(45) **Date of Patent: *Jun. 30, 2009**

(54) SPRING MOUNTING FOR SASH WINDOW TENSIONING ARRANGEMENTS

(75) Inventors: Braid Keith Harold, Braceborough (GB); Braid Christopher Simon, Peterborough (GB)

(73) Assignee: Amesbury Springs Limited, Peterborough (GB)

( * ) Notice: Subject to any disclaimer, the term of this patent is extended or adjusted under 35 U.S.C. 154(b) by 0 days.

This patent is subject to a terminal disclaimer.

(21) Appl. No.: 11/473,872

(22) Filed: Jun. 23, 2006

(65) Prior Publication Data

US 2007/0011846 A1 Jan. 18, 2007

Related U.S. Application Data

(63) Continuation of application No. 10/893,122, filed on Jul. 16, 2004, now Pat. No. 7,076,835, which is a continuation of application No. 10/436,022, filed on May 12, 2003, now Pat. No. 6,848,148, which is a continuation of application No. 10/012,671, filed on Oct. 30, 2001, now Pat. No. 6,584,644.

(30) Foreign Application Priority Data

Nov. 9, 2000 (GB) ..... 0027397.9

(51) Int. Cl.
*E05D 13/00* (2006.01)

(52) U.S. Cl. ..... 16/197

(58) Field of Classification Search ..... 16/197, 16/193, 400, 401, 202, 205, 206, DIG. 16; 49/445–447, 454, 456–457, 176, 181
See application file for complete search history.

(56) References Cited

U.S. PATENT DOCUMENTS

| | | | | |
|---|---|---|---|---|
| 347,508 | A * | 8/1886 | Phillips | 16/211 |
| 2,635,282 | A | 4/1953 | Trammell, Sr. et al. | |
| 3,452,480 | A * | 7/1969 | Foster | 49/445 |
| 3,869,754 | A | 3/1975 | Foster | |
| 3,992,751 | A | 11/1976 | Foster et al. | |
| 4,028,849 | A | 6/1977 | Anderson | |
| 4,089,085 | A * | 5/1978 | Fitzgibbon | 16/197 |

(Continued)

FOREIGN PATENT DOCUMENTS

| | | |
|---|---|---|
| GB | 329996 | 5/1930 |

(Continued)

*Primary Examiner*—Chuck Y. Mah
(74) *Attorney, Agent, or Firm*—Goodwin Procter LLP

(57) ABSTRACT

A sash window counterbalance spring mounting arrangement for fitment into a channel section within a window jamb, includes coiled ribbon springs, a spring support mounting including a single integral component for locating and supporting the springs, a support for the springs to support and locate the springs on the mounting, and formed by pairs of triangular cross section projections extend from the rear surface of the main body of the mounting such that when the springs recoil rapidly outer surfaces of adjacent springs contact each other, and including an end portion of the main body which is curved, wing projections extending from the front surface of the main body, and an inter engagement element on the longitudinal end of the mounting for cooperative engagement with cooperative inter engagement features on a sash shoe, and a locating arrangement for locating the mounting within the channel section.

14 Claims, 5 Drawing Sheets

U.S. PATENT DOCUMENTS

| | | | | |
|---|---|---|---|---|
| 4,227,345 | A | | 10/1980 | Durham, Jr. |
| 4,300,316 | A | | 11/1981 | Ficurilli |
| 4,683,676 | A | | 8/1987 | Sterner, Jr. |
| 4,854,077 | A | | 8/1989 | Rogers et al. |
| 4,922,657 | A | | 5/1990 | Foss |
| 4,935,987 | A | | 6/1990 | Sterner, Jr. |
| 4,953,258 | A | | 9/1990 | Mennuto |
| 4,961,247 | A | | 10/1990 | Leitzel et al. |
| 5,157,808 | A | | 10/1992 | Sterner, Jr. |
| 5,207,025 | A | | 5/1993 | Westfall |
| 5,210,976 | A | | 5/1993 | Cripps |
| 5,232,208 | A | | 8/1993 | Braid et al. |
| 5,353,548 | A | | 10/1994 | Westfall |
| 5,365,638 | A | | 11/1994 | Braid et al. |
| 5,463,793 | A | | 11/1995 | Westfall |
| 5,661,927 | A | | 9/1997 | Polowinczak et al. |
| 5,737,877 | A | | 4/1998 | Meunier et al. |
| 5,996,283 | A | | 12/1999 | Maier |
| 6,148,562 | A | * | 11/2000 | Stark et al. ..... 49/429 |
| 6,553,620 | B2 | | 4/2003 | Guillemet et al. |
| 6,622,342 | B1 | | 9/2003 | Annes et al. |
| 6,802,105 | B2 | | 10/2004 | Polowinczak et al. |

FOREIGN PATENT DOCUMENTS

| | | |
|---|---|---|
| GB | 1505782 | 3/1978 |
| GB | 2254875 | 10/1992 |
| GB | 2278626 | 12/1994 |
| GB | 2295634 | 12/1994 |
| GB | 2295634 | 6/1996 |

* cited by examiner

SPRING MOUNTING FOR SASH WINDOW TENSIONING ARRANGEMENTS

CROSS-REFERENCE TO RELATED APPLICATIONS

This application is a continuation of U.S. application Ser. No. 10/893,122, filed Jul. 16, 2004 now U.S. Pat. No. 7,076,835, which is a continuation of U.S. application Ser. No. 10/436,022, filed May 2, 2003, now U.S. Pat. No. 6,848,148, which is a continuation of U.S. application Ser. No. 10/012,671, filed Oct. 30, 2001, now U.S. Pat. No. 6,584,644, which relates to, and claims the benefit of and priority to, U.K. Patent Application Ser. No. 0027397.9, filed Nov. 9, 2000, the disclosures of which are hereby incorporated herein by reference in their entireties.

FIELD OF THE INVENTION

The present invention relates to sash windows and in particular to a mounting for the spring tensioning arrangement used in such sash windows.

BACKGROUND OF THE INVENTION

Modem sash window arrangements utilise flat coiled ribbon springs which are arranged to unwind as the sash is slid and moved within a window frame. The coiled springs provide a counterbalancing force to counterbalance the weight of the sash window thereby making movement, and opening of the window easier. Typically the coiled springs are mounted, via a mounting arrangement, within a vertical channel section of the window frame or jamb. A free end, referred to as a tail, of the spring is connected to a sash shoe slidably mounted within the channel section of the window frame. The shoe in turn is then connected to the sash window jamb, usually towards the lower portion of the sash window.

The coil springs are generally of a constant tension type in which the outer profile of the coil itself is rotatably held and supported within the mounting whilst the other free end of the spring is free such that the coil spring can rotate as the spring is unwound and the tail is extended. To provide sufficient force to counterbalance the weight of the sash window multiple springs may be provided with the free ends or tails connected together.

An example of a prior arrangement, as generally described above, for a mounting for multiple springs for use in a sash window is described in U.S. Pat. No. 5,365,638. As described in this prior patent, individual mounting means are provided for each of the coil springs. The spring mounting comprises two parallel arranged upstanding wall portions with a coil spring support element interconnecting these wall portions. The coil spring is inserted in between the wall portions with an outer coil surface of the spring supported and resting on the coil spring support element/surface. To provide a multiple spring assembly a number of individual mounting means are provided and stacked into an assembly in the window jamb.

Whilst this mounting arrangement, and similar prior arrangements, provide a practical method of mounting and supporting the springs, there are a number of problems with such an arrangement and the mounting arrangement can be improved generally. Particular problems are that the individual mounting for the springs are relatively complex and involve a number of different components. This increases production costs. The individual mountings also have to be installed individually and/or assembled which increases assembly time and costs. Installation of a stack of mountings within the channel section can also in practice be difficult. The installation of the sash shoe can also be problematic, in particular due to the applied tension of the springs which are attached to them. The correct lateral location of the prior mountings within the channel section and alignment of mounting can also be difficult especially due to the restricted access to the channel section. The stack of mountings secured to the jamb via a single screw fitting also have a tendency to undesirably bow under the tension of the springs. If multiple screw fasteners are used to reduce this bowing then assembly time is increased. It has also been found that dirt can accumulate within the mounting assembly and springs. This can adversely affect performance and operation of the counterbalance. The prior art mountings also obstruct the channel section within which the tilt latch is engaged to locate the sash. Consequently the prior art mountings have to be carefully positioned within the jambs such that opening of the window is not restricted.

SUMMARY OF THE INVENTION

It is therefore desirable to provide an improved sash window spring tensioning mounting arrangement which addresses some or all the above described problems and/or which offers improvements generally.

According to the present invention there is provided a sash window counterbalance spring mounting arrangement as described in the accompanying claims.

In an embodiment of the invention, which includes a number of complementary and/or separate but related aspects and features of the invention, there is provided a sash window counterbalance spring mounting arrangement for fitment into a channel section within a window jamb. The arrangement comprises at least two coiled ribbon springs, a spring support mounting comprising support means for each of said at least two coiled ribbon springs to support and locate said coiled ribbon springs to the spring support mounting, and locating means adapted, in use, to locate the spring support mounting within and to said channel section. The spring support mounting comprises a single integral component from which the support means depend and from which the at least two springs are located and supported.

A spring support mounting comprising a single integral component, i.e. of a one piece format, for a multi spring counterbalance arrangement is much simpler to fabricate than the prior multi piece format conventionally used. The single integral format is also much simpler to fit into the channel section than fitting the individual support mountings for each of the multiple springs as used in the prior art arrangements. Using a single integral support mounting component also allows the multiple springs to be more closely located to each other which reduces the potential bowing of the support mounting under the spring load.

The spring support mounting comprises an elongate plate like main body portion, the main body portion having a front and rear surface. The support means comprises integral projections from a rear surface of the main body portion. Preferably at least one of the at least two springs comprise a pair of triangular cross section integral projections which extend from the rear surface of the main body portion. The triangular cross section projections are respectively disposed laterally on the rear surface with the respective triangular cross sections laterally oppositely directed such that the pair of triangular projections define a cradle for said spring.

Such triangular cross section projections provide a simple and convenient support mounting for the springs. Furthermore they also allow the springs to be located closely together which, as mentioned above, reduces the possibility and problems of bowing of the spring support mounting.

An end portion of the main body portion of the support mounting is curved in a direction extending from the rear surface of the main body such that a tip edge of the end portion of the main body is disposed at a position spaced from a plane of the remainder of the main body portion. The end portion is thereby arranged to provide a curved head portion for the spring support mounting.

Such a curved head to the spring support mounting allows a tilt latch, which engages within the channel into which the support mounting is fitted, to glide over the installed spring support mounting.

When the mounting arrangement is installed within said channel section of the window jamb, the tip edge of the curved head portion is arranged to abut against a wall of said channel section with the curved head portion closing off an end of the mounting arrangement.

The abutment of the tip edge of the curved head portion with a wall of the channel section closes off the end of the mounting arrangement and assists in keeping dirt out of the mounting arrangement and the coiled springs. In addition it also, in part, seals off the channel section so reducing drafts through the channel section.

The curved head portion is resilient and tip edge of the curved head portion is arranged to resiliently abut against said wall of the channel section such that the spring support mounting is urged away from said wall.

The resilient abutment of the curved head and tip thereof ensures that there is a good seal between the tip and curved head portion. It also provides a secure means to locate the support mounting within the channel between the walls of the channel whilst also allowing the mounting arrangement to accommodate any manufacturing tolerance variations in the channel dimensions.

Wing projections extend from the front surface of the main body of the spring support mounting. A distal end of the wing projections is arranged, when the spring mounting is installed within the channel, to abut against a wall of said channel and to space the front surface of the main body of the spring support mounting from said channel wall.

The wing projections provide a means to laterally locate the support mounting within the channel section, whilst spacing the front surface from the channel wall such that a part of the cross section of the channel section is still unobstructed by the support mounting.

On the longitudinal end of the support mounting there are inter engagement means for cooperative engagement with cooperative inter engagement features on a sash shoe. The inter engagement means preferably comprise a finger extension which is arranged to be engaged within a cooperative recess. The finger extension extends from an end of the spring support mounting, and the cooperative recess is defined in an end portion of the sash shoe.

The inter engagement means between the sash shoe and spring support mounting locate and align the sash shoe and spring support mounting such that the sash shoe and spring support mounting can be installed within the channel as a single unit. The alignment of the sash shoe with the spring support mounting also makes the installation of the shoe within the channel easier.

The support means of the spring support mounting are disposed on the spring support mounting such that in use when the at least two springs recoil rapidly an outer surface of adjacent springs contact each other.

By arranging the support means such that the springs contact when they recoil rapidly, a braking effect is provided which slows the recoiling of the springs.

An end of the spring support mounting may be provided with a buffer means for absorbing, in use, an impact of a sash shoe against said end of the spring support mounting. The buffer means may comprise coil tension springs. Alternatively the buffer means comprises a finger extension which is engaged within a recess. The finger extension and recess are profiled such that as the finger extension is inserted into the recess the finger extension and recess progressively and increasingly frictionally engage each other.

Such a buffer means reduces damage that may be caused in the event that the sash shoe impact the spring support mounting.

The spring support mounting is resiliently flexible in directions extending from the front and rear surfaces.

Such flexibility in the support mounting allows the support mounting to be bent during installation of the support mounting within the channel section. This allows the support mounting comprising an elongate single integral component to be inserted through an industry standard channel opening which is shorter in length than the support mounting.

BRIEF DESCRIPTION OF THE DRAWINGS

The present invention will now be described by way of example only with reference to the following figures in which.

DETAILED DESCRIPTION

Figure 1:
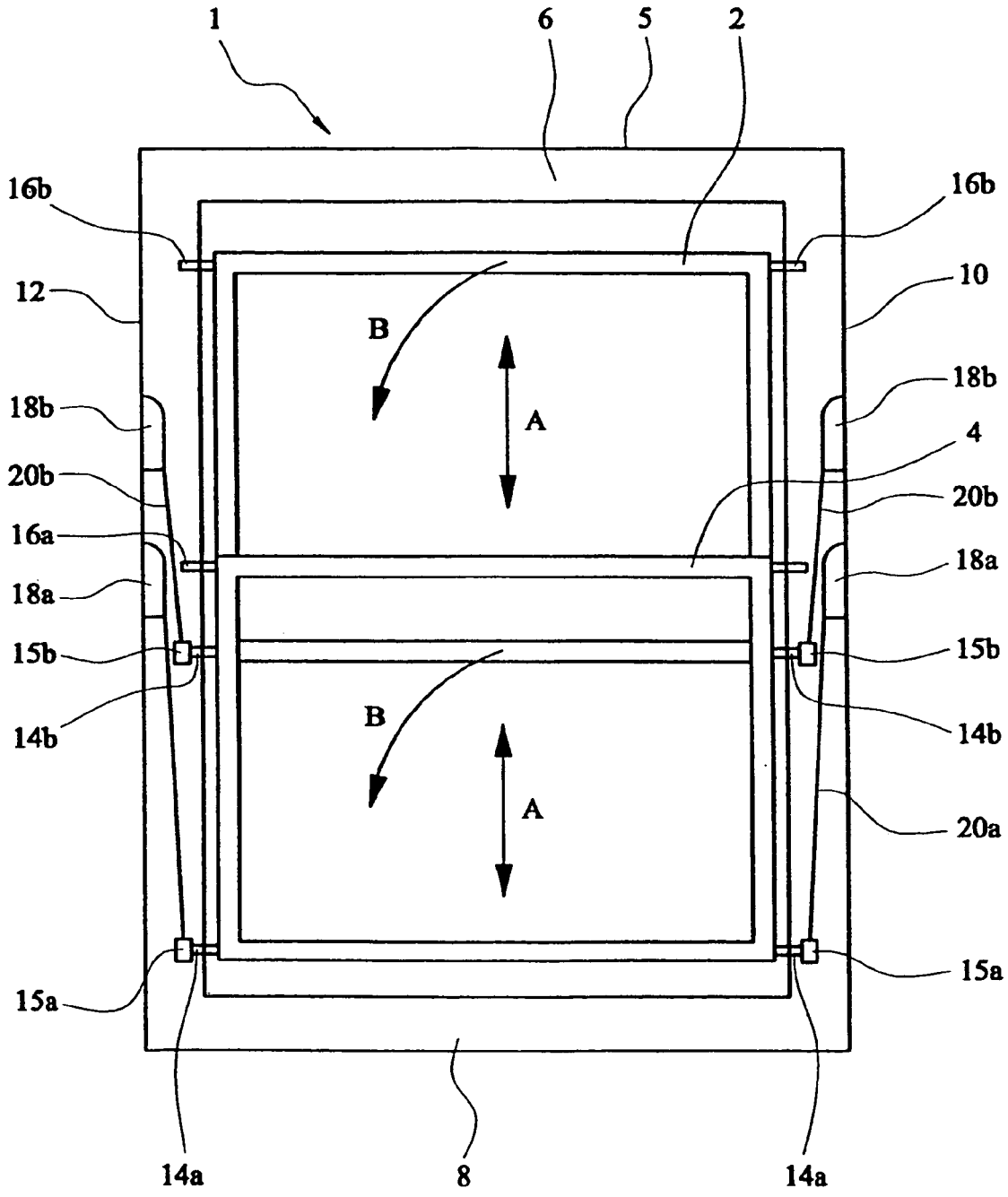
FIG. 1 is a schematic representation of a complete sash window assembly incorporating the counterbalance spring mounting arrangement in accordance with the present invention.
Figure 2:
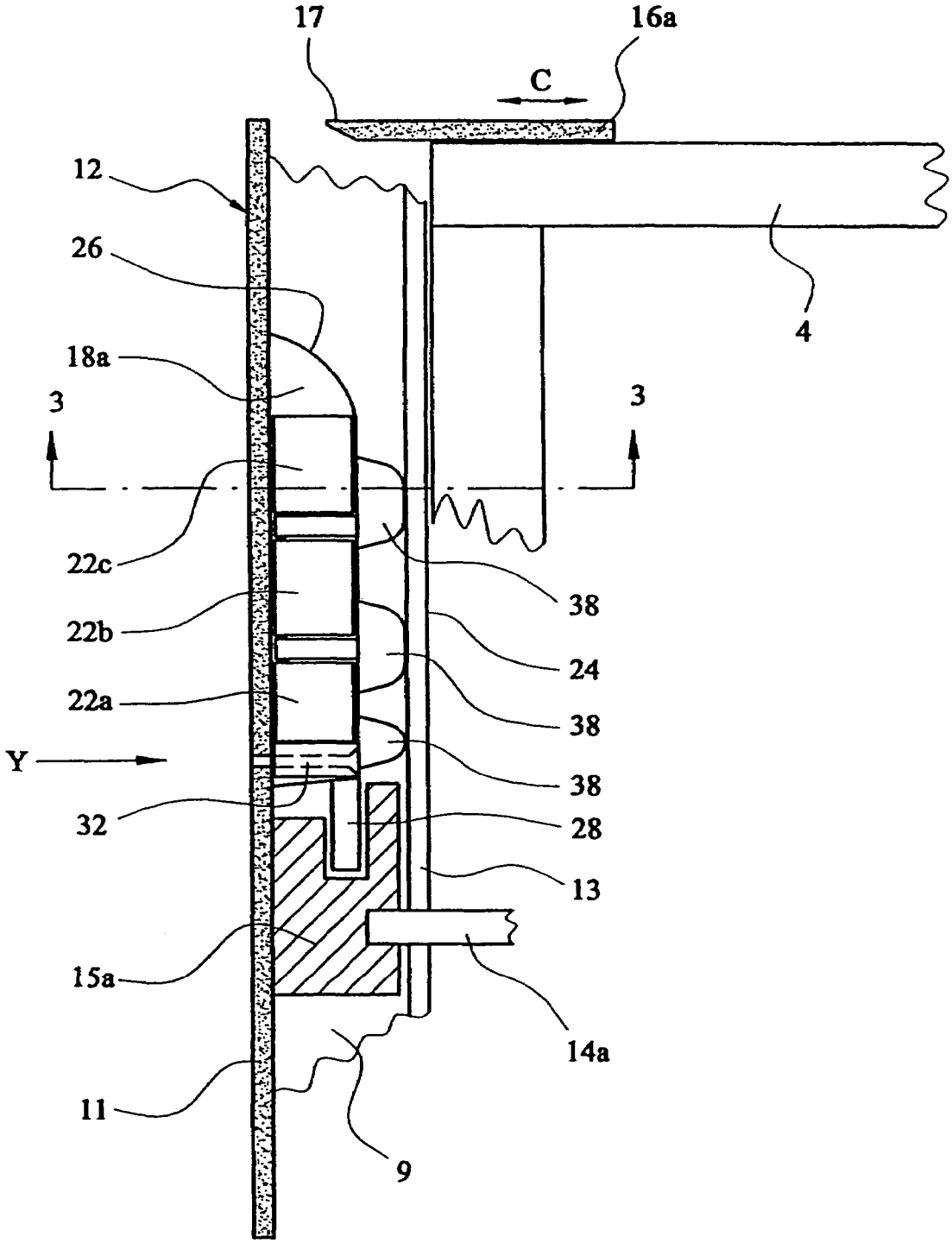
FIG. 2 is a vertical cross sectional schematic view through the window jamb and counter balance spring mounting and in accordance with the invention, and as shown in FIG. 1.
Figure 3:
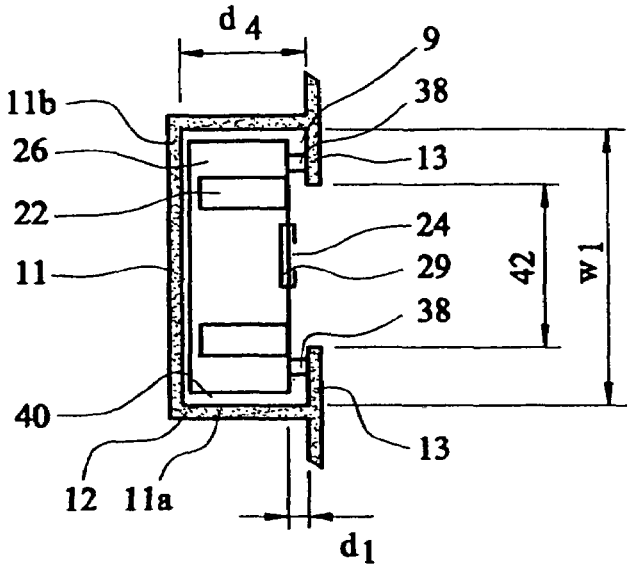
FIG. 3 is a cross sectional view in a vertical direction, on section 3-3 of FIG. 2 through the window jamb and spring mounting of the invention.

Referring to FIG. 1, a sash window comprises upper 2 and lower 4 sashes which are slidably mounted, within a window frame 5 such that each sash 2, 4 can be slid vertically to open the window. The sashes 2, 4 are disposed generally vertically and are disposed closely adjacent to each other with one sash 2 sliding behind the other 4. The window frame 5 comprises upper 6 and lower 8 horizontal frame members and two vertical laterally spaced window jamb members 10, 12. The window jambs 10, 12 have a doubt e vertically extending channel section. Each channel section 9 of the double channel section is disposed side by side within the window jamb adjacent to a respective sash. FIG. 3 shows the profile of each channel section 9 and the two channel sections, of the double channel section within the window jamb 10, 12 are of a similar configuration and are arranged laterally adjacent to each other to form the double channel section of the window jamb 10;12. The open side of each respective channel section 9 extends vertically adjacent to the respective sides of the sashes 2, 4. The channel section 9 comprises rear wall 11 facing outwardly towards the sash 2, 4 from which extend two side walls 11*a*, 11*b*. Short front wall portions 13 generally parallel to the rear wall 11 extend inwardly from the ends of the side walls 11*a*, 11*b* towards each other to partially close off and thereby define a channel or jamb pocket 40 with an opening 42 of the channel 9 of a smaller dimension adjacent to the sash 2, 4. Along a small section (typically 50 mm) of the channel section 9 however the front wall members 13 are removed to provide an enlarged access opening (not shown) into the channel section 9. Such an opening in the channel section 9 is an industry standard and is to allow a spring assembly 18*a*, 18*b* and sash shoe 15*a*, 15*b* to be inserted into the channel section 9.

Pivot pins 14*a*, 14*b*, located towards the lower end of each sash 2, 4, extend laterally from each lateral side of each sash 2, 4. The pivot pins 14*a*, 14*b* extend into a respective channel section 9, through the open side and opening 42 in the channel section 9 and are pivotally engaged within a sash shoe 15*a*, 15*b* which is slidably located within a respective channel section 9 of the window jamb 10, 12. Tilt latches 16*a*, 16*b*, located towards the upper part of each sash 2, 4, similarly extend laterally from each lateral side of each sash 2, 4 with a tip 17 of each tilt latch 16*a*, 16*b* extending into a respective channel section 9 of the window jamb 10, 12 through the open side 42 of the channel section 9. The pivot pins 14*a*, 14*b*, sash shoe 15*a*, 15*b*, and tilt latches 16*a*, 16*b*, thereby slidably locate the sashes 2, 4 within the respective channel sections 9 of the window jambs 10, 12 and secure the sashes 2, 4 within the window frame 5.

The tilt latches 16*a*, 16*b* are arranged to be retracted, as indicated by arrow C, into the sash 2, 4, such that the tip 17 of the tilt latch 16*a*, 16*b* can be withdrawn from the respective channel section 9 of the window jamb 10, 12. The sash 2, 4 can then be pivoted about the pivot pins 14*a*, 14*b*, as indicated by arrow B. This allows, when the sash window is installed, access to the other side of the window for cleaning and other purposes.

To counter balance the weight of the sashes 2, 4, and assist in the vertical sliding of the of sashes 2, 4, a counterbalance mechanism is provided. The counter balance mechanism for each sash 2, 4 comprises a pair of spring assemblies 18*a*, 18*b* mounted in and to the window jambs 10, 12, and specifically within the respective jamb channel and jamb pocket 40, on each lateral side of the sash 2, 4. Each spring assembly 18*a*, 18*b* comprises a number of flat coiled ribbon springs 22*a*, 22*b*, 22*c* which are supported and mounted to the window jamb 10, 12 via a spring assembly mounting 24, as will be described in more detail later. The free outer ends, or tails, of each coiled spring are connected together to form a common tail 20*a*, 20*b* which is drawn out from the spring assembly 18*a*, 18*b* along the channel section 9 of the window jamb 10, 12 and is connected to a respective, sash shoe 15*a*, 15*b*. As the sash 2, 4 slides vertically within the frame 5 the common tail 20*a*, 20*b* is drawn out and retracts into the spring assembly 18*a*, 18*b* with the coil springs 22*a*, 22*b*, 22*c* uncoiling and coiling within the spring assembly 18*a*, lab. As a result a vertical upward force is provided by the springs 22*a*, 22*b*, 22*c* to counterbalance the weight of the sashes 2, 4 and assist in the vertical sliding movement of the sashes 2, 4. The spring assemblies 18*a*, 18*b* for each sash 2, 4 are located at vertical positions within and along the window jamb 10, 12 such that over the full sliding movement of the sashes 2, 4 the springs 22*a*, 22*b*, 22*c* are extended to some degree and are under tension to provide a positive vertical upward force over the entire range of sliding movement of the sashes 2, 4. Typically therefore, and since the tails 20*a*, 20*b* of the springs 22*a*, 22*b*, 22*c* are connected to sash shoes 15*a*, 15*b* towards the lower end of each sash 2, 4 the spring assemblies 18*a*, 18*b* are generally mounted towards the middle of the window jambs 10, 12.

An individual spring assembly 18*a*, in this case for the left hand side of the lower sash 4, is shown in more detail in FIGS. 2 to 7. The other spring assemblies 18*a*, 18*b* which are located in other respective positions in the window jambs 10, 12 and are connected to a respective sash 2, 4 via respective sash shoes 15*a*, 15*b* are generally similar. Consequently only this spring assembly 18*a* will be described in detail.

The spring assembly 18*a* comprises a one piece multi spring support mounting 24 which is dimensioned to fit into and within the channel section 9 of the window jamb 12 with the width W of a main body portion 25 corresponding to the approximate width $W_1$ of the jamb channel 9 within which it is inserted. The spring support mounting 24 is shown on its own more clearly in FIGS. 4 and 6. The spring support mounting 24 comprises a plate like generally rectangular main body portion 25 with a front surface 21 which when installed in the jamb 12 faces outwards from the window jamb channel section 9, and a rear surface 23 which faces towards and into the jamb channel section 9. Integral with the main body portion 25 and extending from the rear surface 23 thereof are spring support projections 33, 35, 37 disposed at spaced positions along the length of the main body portion 25 of the spring support mounting 24.

Figure 5:
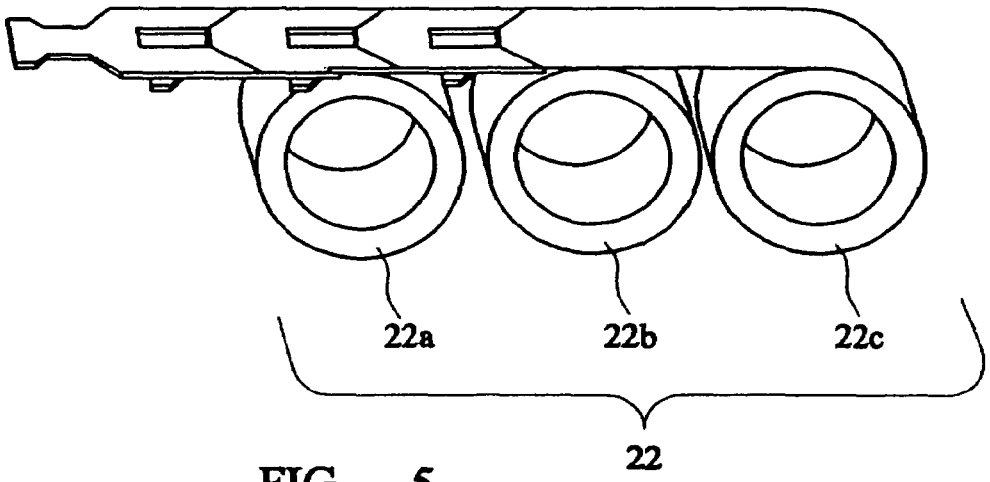
FIG. 5 is a schematic perspective view of the arrangement of springs alone as arranged in the mounting of FIG. 2.
Figure 6:
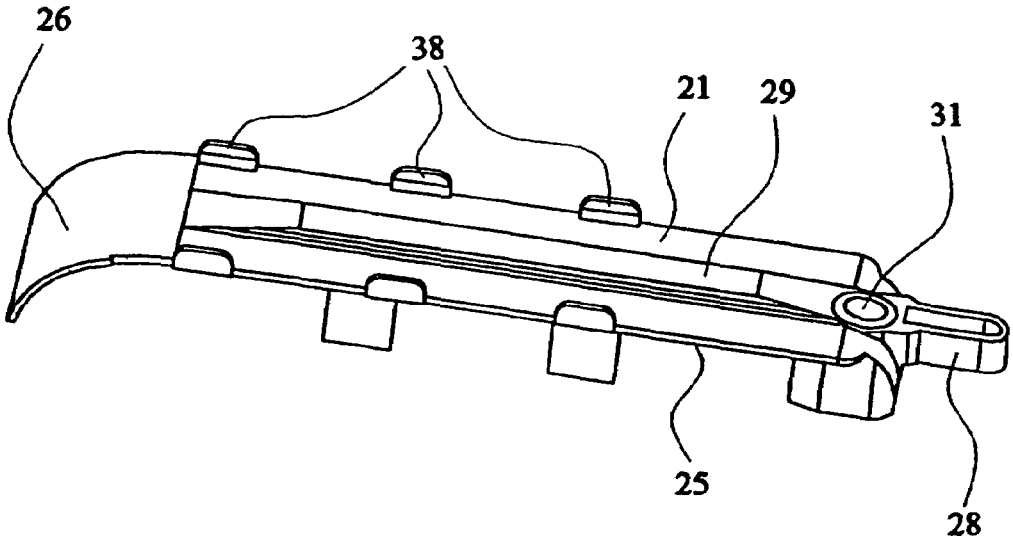
FIG. 6 is a further schematic perspective view of the mounting body, similar to that of FIG. 4, but showing the facing surface of the body portion.
Figure 7:
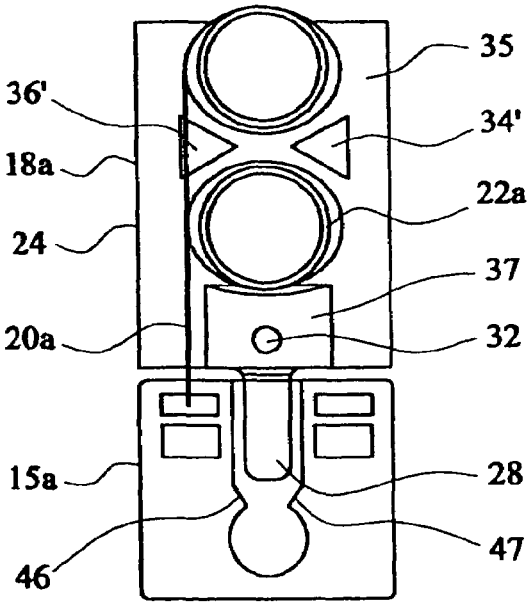
FIG. 7 is a more detailed schematic cross sectional view on arrow Y of the mounting and sash shoe.

Three flat ribbon coiled springs 22, lower 22*a*, middle 22*b* and upper 22*c* (as considered in their final installed positions shown in FIG. 2) are arranged as shown in FIG. 5 with the outer free ends or tails of each spring connected together to form a common tail 20*a*. The springs 22 are located within and on the spring support mounting 24. The outer coiled body portions of the three flat coiled ribbon springs 22 are supported by and on the respective spring support projections 37, 35, 33 of the spring support mounting 24. An axial end/side face of the coil springs 22 abuts against the rear surface 23 of the main body portion 25 of the support mounting 24. Since the other axial end/side face of the coil springs is not enclosed by the support mounting the springs 22 can be fitted into the support very easily. Once the spring assembly 18*a*, (support mounting 24 and springs 22) is installed into the jamb 12 and channel section 9, the exposed axial end/side face of the spring is however then enclosed by the rear wall of the channel section which once the assembly 18*a* is installed prevents the springs 22 from sliding axially off the support projections 33, 35, 37.

The inner free ends of the flat ribbon coil springs 22 are generally free such that as the springs 22 unwind they rotate within the spring support mounting 24 and the springs 22 provide a generally constant force as they are, in use, unwound.

The lower spring support projection 37 (shown to the left of FIG. 4) is of a generally rectangular section with one side of a curved/bowed profile to define a curved cooperating support surface 44 for the outer profile of the lower coil spring 22*a*.

The centre support projection 35 comprises a pair of triangular cross section projections 34, 36 disposed on either side of the rear surface 23 or the main body 25. The triangular cross section projections 34', 36' are arranged with a base side of the triangular section generally parallel to the longitudinal edge of the main body 25 and with an apex towards the centre of the main body 25. The triangular projections 34', 36' are separated such that there is a space between the respective projections 34', 36' in the centre of the main body 25. The pair of triangular projections 34', 36' thereby define a cradle within which the outer profile of the middle spring coil 22*b* is located and is supported. The shape of the triangular projections 34', 36' may preferably be profiled to cooperate with the outer profile of the spring 22*b*, however exact correspondence in profile is not required to provide support for the spring 22*b*. The centre support projection 35 is also adjacent to the lower coil spring 22*a* and so prevents movement of the lower spring 22*a* in an upwards direction when installed. In effect the triangular projections 34, 36 occupy the generally triangular space between adjacent springs 22*a*, 22*b* to thereby locate these springs 22*a*, 22*b* within the mounting 24 and support the springs 22*a*, 22*b* when the assembly 18*a* is installed.

The upper support protection 34 is the same as the centre support projection 35 and the upper spring 22*c* is supported by one side surface of the respective triangular projections 34, 36 whilst the centre spring 22*b* is also adjacent to the lower side surface of the triangular projections 34, 36.

Figure 4:
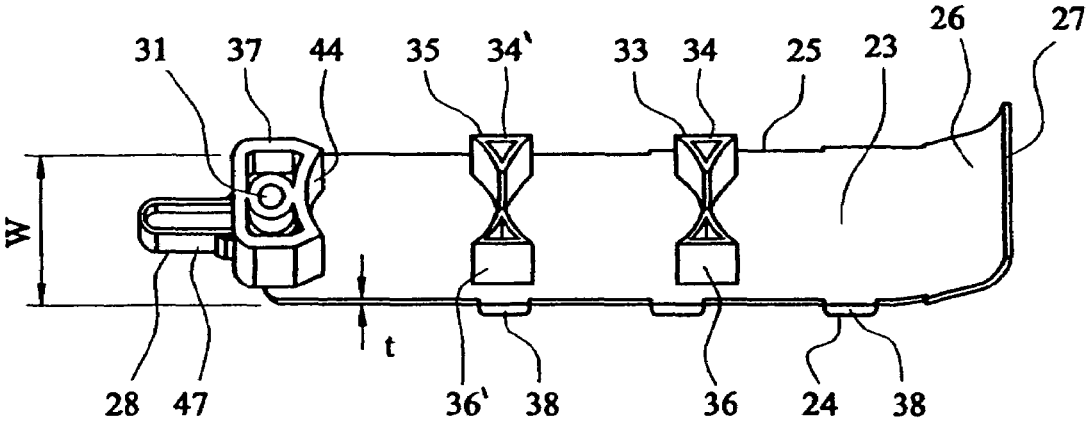
FIG. 4 is a schematic perspective view of the mounting support of FIG. 2 but in isolation, showing the rear surface of the mounting body.

It will be appreciated that the number of springs may be different in other embodiments of the invention depending on the counterbalance force that is required and additional, or fewer support projections can be provided. For example in FIG. 9 a support mounting of the same general type (in which like reference numerals have been used for like features) as that of FIG. 4 is shown but for mounting two springs 22. The invention however and its advantages are though particularly and mainly applicable to multiple spring mountings which include and provide a mounting for a minimum of two springs.

With the triangular projections 34, 34', 36, 36' located towards the sides of the main body 25, and by virtue of the one piece format for the support mounting 24, the springs 22 are located relatively close together along the support structure 24. Indeed the springs 22 can with this support mounting 24 be located such that when fully wound, and of a maximum diameter, the outer profile of adjacent springs 22*a*, 22*b* and 22*b*, 22*c* almost touch in the centre space between the triangular support projections 34, 34', 36, 36'. As a result the overall length of the spring assembly 18*a* is considerably less than that of previous arrangements incorporating similar sized springs. In addition bowing of the support mounting 24 due to the spring 22 loads is reduced.

It has also been found that when coil springs 22 of this type retract and rewind quickly, for example if the load of the sash window is suddenly removed or the window is moved upward quickly, then the outer diameter of the coil spring 22 expands to a diameter greater than that of the naturally coiled spring or present under normal recoiling of the spring 22 under slower movement. With this support mounting the springs 22 can be arranged such that when they quickly retract the outer profile of the adjacent springs 22*a*, 22*b* and 22*b*, 22*c* contact each other and for the lower 22*a* and middle 22*b* springs they contact the adjacent triangular supports 35, 33 for the adjacent springs 22*b*, 22*c*. This contact advantageously brakes the retraction of the springs 22 and slows the retraction and movement of the sash 2, 4. The contact between adjacent springs 22*a*, 22*b* and 22*b*, 22*c* provides a particularly efficient braking action since respective opposite sides of the springs 22, which are moving in opposite directions at the point of contact, contact each other.

The spring support mounting 24, as shown in FIG. 4, is preferably made of a relatively flexible plastic material, for example nylon or acetyl. The spring support mounting 24, including integral spring support projections 37, 35, 33, is fabricated as a single piece construction preferably by injection moulding. The one piece format of the support mounting 24 simplifies assembly by reducing the number of parts involved and also reduces production and assembly costs. In particular such a one piece unit is cheaper to fabricate than having to make a number of, generally different individual support mountings for the individual springs.

The main body 25 of the support mounting 24 is relatively thin t, typically about 1 mm. Consequently the main body portion 25, of spring support mounting 24 is relatively flexible and can be bent to allow the spring assembly 18*a*, which overall is longer than the typical 50 mm length of the access opening in the channel section 9, to be inserted through the industry standard 50 mm access opening (not shown) in the channel section 9 of the window jamb 12. The spring assembly 18*a* is then slid down within the channel section 9 to the correct position. The flexibility of the support mounting 24 of the present invention and one piece format, means that the support is simpler to manufacture and install into the channel section 9 of the jamb 12 as compared to the prior arrangement. This can be contrasted with prior arrangements, for example as shown in U.S. Pat. No. 5,365,638, in which the support mountings are of a rigid plastic multi piece construction with each piece of the support required to be small enough to be individually inserted through the access opening and then connected together once installed into the channel.

Wing projections 38 located at the edges of the main body 25 of the support mounting 24 and integral with the support mounting 24 extend from the front surface 21 of the support mounting. When the support mounting 24 is installed and fitted into the channel section 9 of the jamb 12 these wing projections 38 bear against the rear of the front walls 13 of the channel section as shown in FIG. 3. The wing projections 38 thereby provide a means to locate the support mounting 24 within the channel section 9. The wing projections, being fabricated from the same flexible plastic material as the rest of the support mounting 24, are also flexible enough to bend slightly and accordingly take up any manufacturing tolerance variations in the dimensions of the channel section 9. The wing projections 38 also space the front surface 21 of the support mounting 24, a distance d1 away from the channel opening 42 such that a recess is still defined in the region of the mounting 24 to allow the tip 17 of the tilt latch 16*a* which extends into the channel section 9 to remain engaged within the channel 9 as it passes over the mounting 24.

Figure 10:
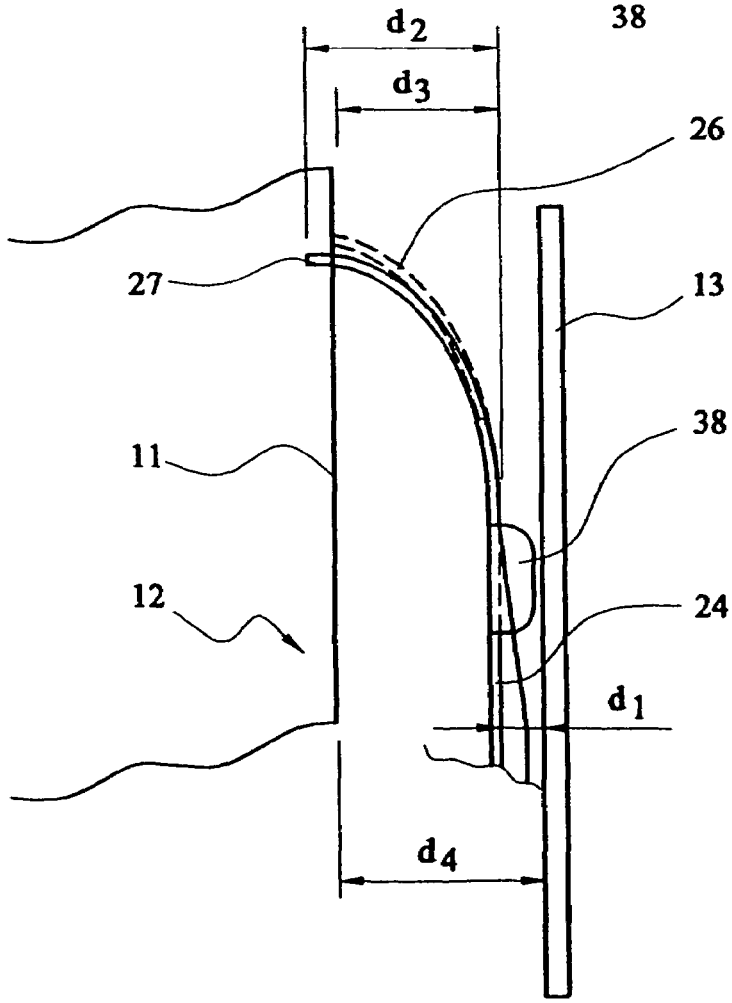
FIG. 10 is a side elevational view showing the support mounting fit into the channel.

The end portion of the main body 25 of the support mounting 24 (when installed the top end of the support mounting) is curved away from the rear surface of the support mounting in a direction extending from the rear surface to provide a curved head 26, with in effect the end portion 26 being curved longitudinally back upon the remainder of the main body 25 of the rear surface 23 of the support mounting 24. The curved head portion 26 curves and bows back towards the support projections 33 and closes off that end of the support mounting 24. The tip edge 27 of the curved head is therefore disposed a distance $d_2$ from the front surface 21, and the rest of the main body 25 of the support mounting 24. Preferably this distance $d_2$, is slightly greater than the depth $d_4$ of the channel section 9 within which the support mounting 24 is fitted. When the support mounting 24 is fitted into the channel section 9, and since the main body 25 is relatively flexible, the curved head portion 26 is bent and straightened slightly such that the tip edge 27 is a closer distance $d_3$ from the rear surface 23 and rest of the main body 28 of the support mounting 24. This allows the support mounting 24 to fit into the channel section 9. This is shown in exaggerated form in FIG. 10 with the installed position of the curved head 26 indicated in phantom, as compared to the normal unreflected free position of the curved head portion shown in solid line. As a result of this bending of the curved head portion 26 when installed, the tip edge 27 of the curved head 26 resiliently presses against the rear wall 11 of the jamb 12 channel section 9. This urges the front surface 21 and main body 25 of the support mounting 24 outwards and presses the wing projections 38 against the inner surfaces of the front walls 13 of the channel section 9. The support mounting 24, and in particular the top end of the mounting 24, is thereby located relatively securely between the front 13 and rear walls 11 of and within the channel section 9 of the jamb 12. The resilience and bending of the curved head 26 accommodates any manufacturing tolerances within the depth $d_4$ of the channel section 9. The curved head portion 26 and abutment against the channel section 9 wall 11 when the support mounting 24 is installed also provides a tight seal within the channel section 9 which reduces drafts. The curved head 26 also encloses the top of the spring assembly 18*a* with the springs 22 enclosed by the curved head 26, main body 25, and channel section 9 walls of the jamb 12. As a result dirt, which may interfere with the springs 22 is kept out of the assembly 18*a* and the springs 22 are protected to some degree.

The curved head portion 26 also deflects the tilt latch 16*a* into the sash allowing the tilt latch 16*a* to glide over the mounting 24 as the sash 2, 4 is moved. It will be appreciated that the tilt latch 16*a* normally extends a considerable distance into the channel section 9 to provide a secure and robust location of the top of the sash 2, 4. When passing over the support mounting 24 the tilt latch 16*a* is still though engaged within the channel section 9 and jamb 12 due to the spacing of the support mounting 24 from the front walls 13 by the wings 38 and due to a groove formed within the front surface 21 of the support mounting 24. The lower end of the support mounting may also preferably be of a curved profile to allow the tilt latch 16*a* to glide over the support mounting 24 when the sash 2, 4 and tilt latch 16*a*, 16*b* are moved over the support mounting 24 from below the support mounting 24.

The lateral location and positioning of the support mounting 24 within the channel section 9 itself, as opposed to the vertical position, is provided by the abutting of the wing projections 38 with the front wall 13, the bearing of the tip edge 27 of the curved head 26 against the rear wall 11 and the width W of the support mounting 24 with the longitudinal edges abutting the side walls 11*a*, 11*b* of the channel section 9. However to locate the support mounting 24 vertically along the channel section 9 and to secure the support mounting 24 to the jamb 12 an aperture 31 is defined within the lower support projection 37. A single mounting screw 32, is engaged within this aperture 31 and, when the spring assembly 18*a* is fitted into the jamb 12 this secures the spring support mounting 24 as a whole to the window jamb 12. Since the width W of the support mounting 24 corresponds generally to that $W_1$ of the channel section 9 the support mounting 24 is restrained from rotating about the single screw 32 fitting. The one piece format of, the support mounting 24 for supporting multiple springs 22 enables the single screw 32 fitting to secure the support mounting 24 to the jamb 12. This can be contrasted with some prior arrangements in which individual mounting structures which are individually secured to the jamb are used. The use of a single fixing screw 32 represents a simplification and reduces assembly and installation time.

The support mounting 24 may in alternative embodiments be secured and located vertically within the channel section 9 and jamb using pegs, spigots or catches instead of the single screw fastening described and shown. The screw fitting 32, or other securing means may also locate the support mounting 24 against the rear wall 11 of the channel section 9 and within the channel section 9 in other embodiments, and in particular in other embodiments which do not include the curved head 26 and/or wing projections 38.

The support mounting 24 also includes an integral finger extension projection 28 which extends from an end of the main body portion 25. This finger 28 is engageable within a cooperatively shaped recess 46 within the sash shoe 15*a* to which the tails 20*a* of the springs 22 are attached and which is located beneath the spring assembly 18*a* within the channel section 9 of the window jamb 12. This finger extension projection 28 provides a means to locate the sash shoe 15*a* relative to and with the spring assembly 18*a* such that both the shoe 15*a* and spring assembly 18*a* can be inserted into the channel section 9 together as a single unit. This aids assembly and furthermore makes it easier to slide the sash shoe 15*a* to the correct, position since the spring assembly 18*a* provides a means for more easily guiding the sash shoe 15*a* within the channel section 9. The finger 28 also, by locating the sash shoe 15*a* relative to the spring assembly 18*a*, holds and locates the sash shoe 15*a* in position preventing it from twisting under pressure from the springs 22. Such twisting of the shoe 15*a* may cause the shoe 15*a* to jam in the channel section 9 as it is being installed and consequently by preventing such twisting assembly is made easier. It will be appreciated that such twisting of the sash shoe 15*a* is not a problem once the shoe 15*a* is installed and attached to the sash 4 due to the load of the sash 4 on the shoe 15*a*.

Figure 8:
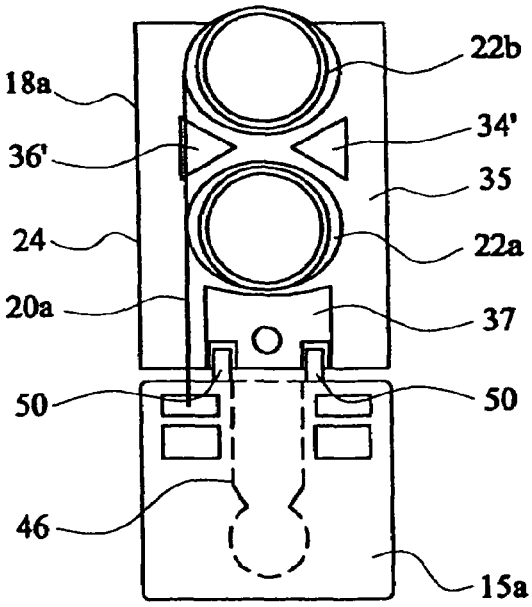
FIG. 8 is a similar view to that of FIG. 7 but showing an alternative arrangement of the mounting and sash shoe.
Figure 9:
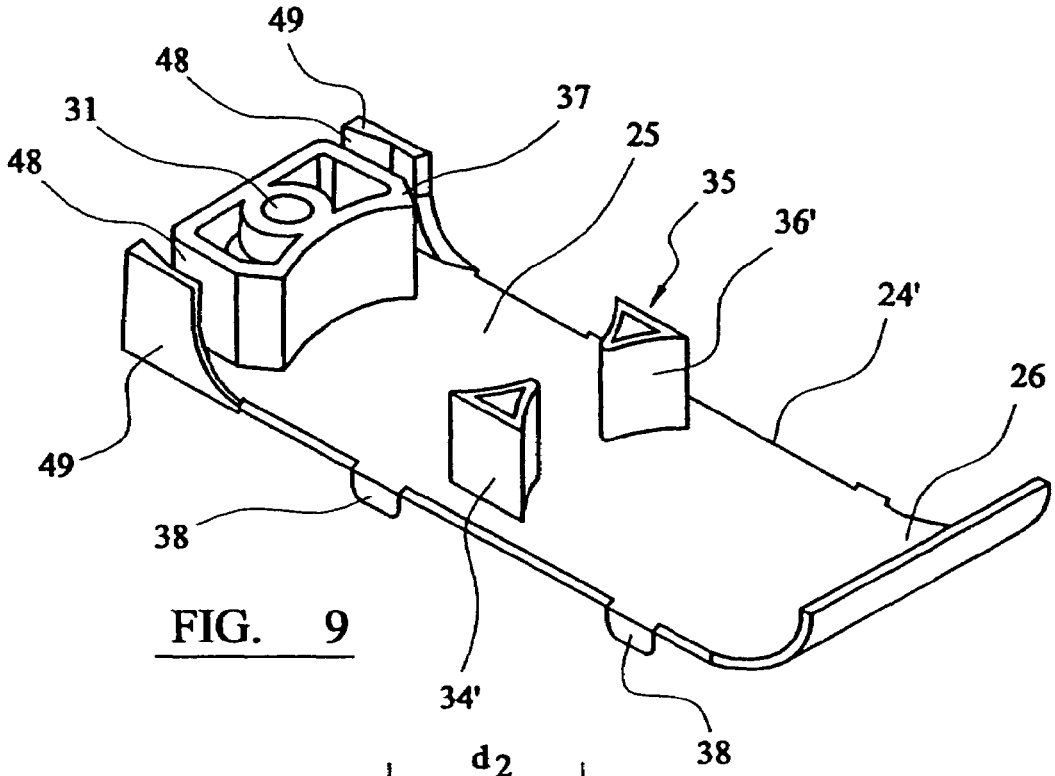
FIG. 9 is a schematic perspective view, similar to that of FIG. 4, but of an alternative embodiment of the mounting.

The finger extension 28 also provides a buffer zone to absorb the impact of the sash shoe 15*a* on the lower end of the spring support assembly 18*a*. Such impact may occur in the event of excessive rapid opening and sliding of the sash 4 or if the sash 4, and so load on the sash shoe 15*a*, is suddenly removed from the shoe, for example during removal of the sash 4. This buffer action can be further enhanced by tapering of the recess 46 and/or finger extension 28 such that they progressively engage and abut as the finger 28 is inserted into the recess 46. The recess surface 47, and/or finger outer profile surface 47, could also be serrated to increase the contact friction between them which further improves the impact absorbency. In an alternative arrangement the positions of the finger 28 and recess 46 could be reversed with the sash shoe 15*a* including finger projections which engage within slots in the main body of the mounting. A suitably shaped mounting support 24 is shown in FIG. 9 with slots 48 defined between projections 49 from the main body 25 and the lower mounting projection 37. In a yet further variation, shown in FIG. 8, coil compression springs 50 are mounted on the lower end of the support mounting 24 and are arranged to axially abut against shoulders on the sash shoe 15*a*. It will be appreciated that alternatively springs could be mounted on the sash shoe 15*a*. In this arrangement of FIG. 8 a finger projection could also be incorporated to locate the sash shoe 15*a* and spring assembly 18*a*.

As described the spring support mounting 24 is fixed to and within the jamb 12 and the sash shoe 15*a* is, in use, slidable within the channel section 9 and is attached to the sash 4. This is the preferred arrangement. It will be appreciated though that this arrangement could be reversed in other embodiments and the spring support 24 could be slidably located within the channel section 9 of the jamb 12 and pivotally attached to the sash 4 with a fixed shoe. The vertical positions of the pivot pins 14*a* and tilt latches 16*a* could also be reversed with the pivot pins located at the top of the sash 4 and the tilt latch 16*a* towards the lower part of the sash 4.

Along the front surface 21 of the mounting 24, and extending longitudinally there is a spine 29 which projects from the front surface 21 and runs along the centre of the front surface 21. This spine 29 reinforces and stiffens the support mounting 24 again assisting in preventing bowing of the support mounting. In alternative arrangements a longitudinal groove indentation could be provided and defined within the front surface 21 of the mounting 24 instead of a raised spine 29. Such a longitudinal indentation would similarly stiffen and strengthen the support mounting. In addition a longitudinal groove would provide a track and groove within which the tip of the tilt latch could run as the tilt latch in use passes over the support mounting 24.

Many other variations of the inventions will also be apparent to those skilled in the art are contemplated. Furthermore various combinations, and use of individual advantageous features of the different embodiments described may be used individually or in other combinations from those described are also contemplated.

What is claimed is:

1. A sash window counterbalance spring mounting arrangement for use in a channel section within a window jamb, comprising:

a spring support mounting comprising:

a main body comprising:

a generally rectangular plate comprising a rear surface configured to face inward to the window jamb channel section when installed in the jamb, at least one projection extending from the rear surface for supporting and locating at least one coiled ribbon spring, an opposing front surface, two opposing longitudinal sides, and two opposing ends; and a head portion extending from one of the opposing ends and the rear surface of the main body, wherein the head portion comprises a tip edge at a distal end thereof, and wherein the tip edge extends beyond a distal end of the at least one projection when unrestrained, such that the tip edge can engage a wall of the jamb channel and resiliently abut the wall of the channel section when the spring support mounting is placed therein, and wherein the spring support mounting comprises a single unitary component.

2. The mounting arrangement of claim 1, wherein the head portion is curved in a neutral position and partially straightened when the spring support mounting is disposed in the channel section within the window jamb.

3. The mounting arrangement of claim 1, further comprising a spine projecting from the front surface of the main body of the spring support mounting, the spine at least partially disposed centrally between the two opposing longitudinal sides of the main body.

4. The mounting arrangement of claim 1, wherein the spring support mounting is fabricated by injection molding.

5. A sash window counterbalance spring mounting arrangement for use in a channel section within a window jamb, comprising:

a spring support mounting comprising:

a main body comprising:

a generally rectangular plate comprising a rear surface configured to face inward to the window jamb channel section when installed in the jamb, an opposing front surface, two opposing longitudinal sides, and two opposing ends, the plate configured to support and locate at least two coiled ribbon springs; and a spine projecting from the front surface of the main body of the spring support mounting, the spine at least partially disposed centrally between the two opposing longitudinal sides of the main body, wherein the spring support mounting comprises a single unitary component.

6. The mounting arrangement of claim 5, further comprising at least one inter-engagement element extending from one of the opposing ends of the main body of the spring support mounting and configured to engage with a top portion of a sash shoe.

7. The mounting arrangement of claim 6, wherein the at least one inter-engagement element comprises a finger extension that is receivable in a recess of the sash shoe.

8. The mounting arrangement of claim 5, wherein the spring support mounting comprises at least one projection extending from the rear surface of the main body for supporting and locating at least one of the two coiled ribbon springs.

9. The mounting arrangement of claim 5, wherein the spring support mounting is fabricated by injection molding.

10. A sash window counterbalance spring mounting arrangement for use in a channel section within a window jamb, comprising:

a spring support mounting comprising:

a main body comprising:

a generally rectangular plate comprising a rear surface configured to face inward to the window jamb channel section when installed in the jamb, at least one projection extending from the rear surface for supporting and locating at least one coiled ribbon spring, an opposing front surface, two opposing longitudinal sides, and two opposing ends, the plate configured to support and locate at least two coiled ribbon springs; and a spine projecting from the front surface of the main body of the spring support mounting, the spine at least partially disposed centrally between the two opposing longitudinal sides of the main body, wherein the spring support mounting comprises a single unitary component, wherein the spring support mounting further comprises a head portion extending from one of the opposing ends and the rear surface of the main body, the head portion comprising a tip edge at a distal end thereof, wherein the tip edge extends beyond a distal end of the at least one projection when unrestrained, such that the tip edge can engage a wall of the jamb channel and resiliently abut the wall of the channel section when the spring support mounting is placed therein, and wherein the at least one projection extends from the rear surface for supporting and locating at least one coiled ribbon spring when unrestrained.

11. The mounting arrangement of claim 10, further comprising at least one inter-engagement element extending from one of the opposing ends of the main body of the spring support mounting and configured to engage with a top portion of a sash shoe.

12. The mounting arrangement of claim 10, wherein the at least one inter-engagement element comprises a finger extension that is receivable in a recess of the sash shoe.

13. The mounting arrangement of claim 10, wherein the spring support mounting comprises at least one projection extending from the rear surface of the main body for supporting and locating at least one of the two coiled ribbon springs.

14. The mounting arrangement of claim 10, wherein the spring support mounting is fabricated by injection molding.

* * * * *